US006533270B2

(12) United States Patent
Gritzuhn

(10) Patent No.: US 6,533,270 B2
(45) Date of Patent: Mar. 18, 2003

(54) DELIVERY SYSTEM

(75) Inventor: Dieter Rolf Gritzuhn, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/850,030

(22) Filed: May 7, 2001

(65) Prior Publication Data

US 2001/0054789 A1 Dec. 27, 2001

(30) Foreign Application Priority Data

May 15, 2000 (DE) ..... 100 23 797

(51) Int. Cl.[7] ..... B65H 5/00

(52) U.S. Cl. ..... 271/264; 271/182; 271/207; 271/209

(58) Field of Search ..... 271/207, 209, 271/182, 264

(56) References Cited

U.S. PATENT DOCUMENTS

| | | | | |
|---|---|---|---|---|
| 5,193,799 A | | 3/1993 | Scheufler et al. | 271/213 |
| 6,027,269 A | * | 2/2000 | Yoshida | 271/209 X |
| 6,065,747 A | * | 5/2000 | Khovaylo et al. | 271/209 |
| 6,134,418 A | * | 10/2000 | Kato et al. | 271/207 X |
| 6,241,245 B1 | * | 6/2001 | Hollar et al. | 271/264 X |

FOREIGN PATENT DOCUMENTS

| | | |
|---|---|---|
| DE | 23 63 224 A | 12/1973 |
| DE | 85 29 570 U1 | 1/1986 |
| DE | 2 47 433 A1 | 8/1987 |
| DE | 90 02 392 U1 | 5/1990 |
| GB | 20 17 622 A | 10/1979 |

* cited by examiner

*Primary Examiner*—David H. Bollinger
(74) *Attorney, Agent, or Firm*—Lawrence P. Kessler

(57) ABSTRACT

A delivery system (1) for flat material (2), in particular sheet paper, with a guideway (3) and at least two glide elements (4) extending in the direction of conveyance (10), whose surface (5) opposite the guideway (3) is elevated in construction and the guideway exhibits substantially reduced friction vis-a-vis the flat material.

11 Claims, 2 Drawing Sheets

DELIVERY SYSTEM

FIELD OF THE INVENTION

BACKGROUND OF THE INVENTION

The invention relates to a delivery system for flat material, in particular sheet paper, with a guideway and at least two glide elements extending in the direction of conveyance, whose surface opposite the guideway is elevated.

A delivery system is disclosed in DE-90 02 392.7 U1. According to the subject matter of this DE disclosure, ribbed projections are provided on a guideway, as a result of which sheets to be delivered slide on these projections until they reach their defined final position. The danger exists in this connection that the first sheet to be delivered will not reach its final position if it misslides. A slanting position may arise if the sheet to be delivered misslides to one side.

SUMMARY OF THE INVENTION

The object of the invention is to make available a delivery system with which a flat material can be conveyed safely into a defined delivery position.

The object is solved in accordance with the invention in that the surfaces of the glide elements opposite the surface of the guideway exhibit substantially reduced friction vis-à-vis the flat material.

The advantage of the invention lies in the fact that easy sliding on the surface of the glide elements up to the defined delivery position is assured. Further advantages are obtained through expedient refinements.

One particularly expedient refinement provides that the guideway is a delivery table and that an increased friction of the guideway surface and the height differential of this surface to the surface of the glide elements are dimensioned in such a way that a flat material, upon completion of its conveyance, deposits itself non-slippably on the surface of the guideway. By virtue of this refinement, the flat material slides on the surface of the glide elements until it comes to rest and then, overcoming the height differential, deposits itself on the surface of the guideway whose increased friction ensures that slippage of the delivered flat material and, accordingly, other flat materials being stacked into a pile on the first material delivered, is no longer possible. The higher the stack, the greater the resulting bearing pressure, and secure stack position is thereby assured.

One expedient refinement provides that the glide elements are constructed as strips glued to the surface of the guideway. As a result thereof, the glide elements are substantially easier and more economical to produce than is the case with the state of the art cited at the outset because there they are incorporated into the delivery table. The construction as glued-on strips also offers the advantage that the glide elements can be made from a material other than that of the guideway, for example, from plastic which, vis-à-vis the flat material to be delivered, exhibits lower friction than that, for example, of the metal of the delivery table. It has been shown that the glide elements are expediently made of polytetrafluoroethylene, commonly referred to as Teflon®.

Conveyance of the material to be delivered can occur in different ways. Conveyance is possible by the upstream machine or a conveyance and positioning device can be provided. Good interaction with the glide elements in accordance with the invention is given if conveyor rollers with high friction surfaces and a control mechanism are provided which convey the flat material in a predetermined manner. The flat material is expediently delivered by conveyor rollers in a defined manner by conveying it to its delivery position. The above-described effect can be achieved if, during conveyance, the flat material slides on the glide elements and after conveyance has come to a stop, delivery occurs on the surface of the glide elements with increased friction.

The final position of the flat material and, accordingly, the defined delivery position can be achieved either by the above-mentioned conveyor rollers or it is possible for defined delivery to occur by a stop at the end of the guideway. Of course, both steps can also be combined together. A further measure to achieve defined delivery in combination with the steps already proposed or acting by itself can include providing a surface with increased friction in the back area of the delivery table. This surface is preferably provided at least at the height of the gliding element surface. As a result thereof, the flat material deposits itself with its back area on this surface with increased friction, whereby first its movement is absorbed and thereafter protection against shifting is achieved. The surface with increased friction also is expediently formed by a glued-on strip. Rubber has shown itself to be an advantageous material in this connection.

In order to ensure that the flat material is conveyed over the surface with increased friction, tongues can be provided by which the flat material slides over the surface with increased friction and which after delivery of the material can be withdrawn from the delivery area. It is also possible in this connection for the tongues to completely or partially cover the surface with increased friction. At the same time, this surface with increased friction and the tongues can act together with the conveyor rollers and, if necessary, even with a hold-down clamp to ensure positioning of the material so that the flat material first reaches the defined delivery position and then is securely positioned.

BRIEF DESCRIPTION OF THE DRAWINGS

The invention is elucidated in the following on the basis of the drawing, with references to further refinements. Shown are, in FIG. 1 an exemplified embodiment in perspective view, FIG. 2 a further exemplified embodiment in a side view.

DETAILED DESCRIPTION OF THE INVENTION

Figure 1:
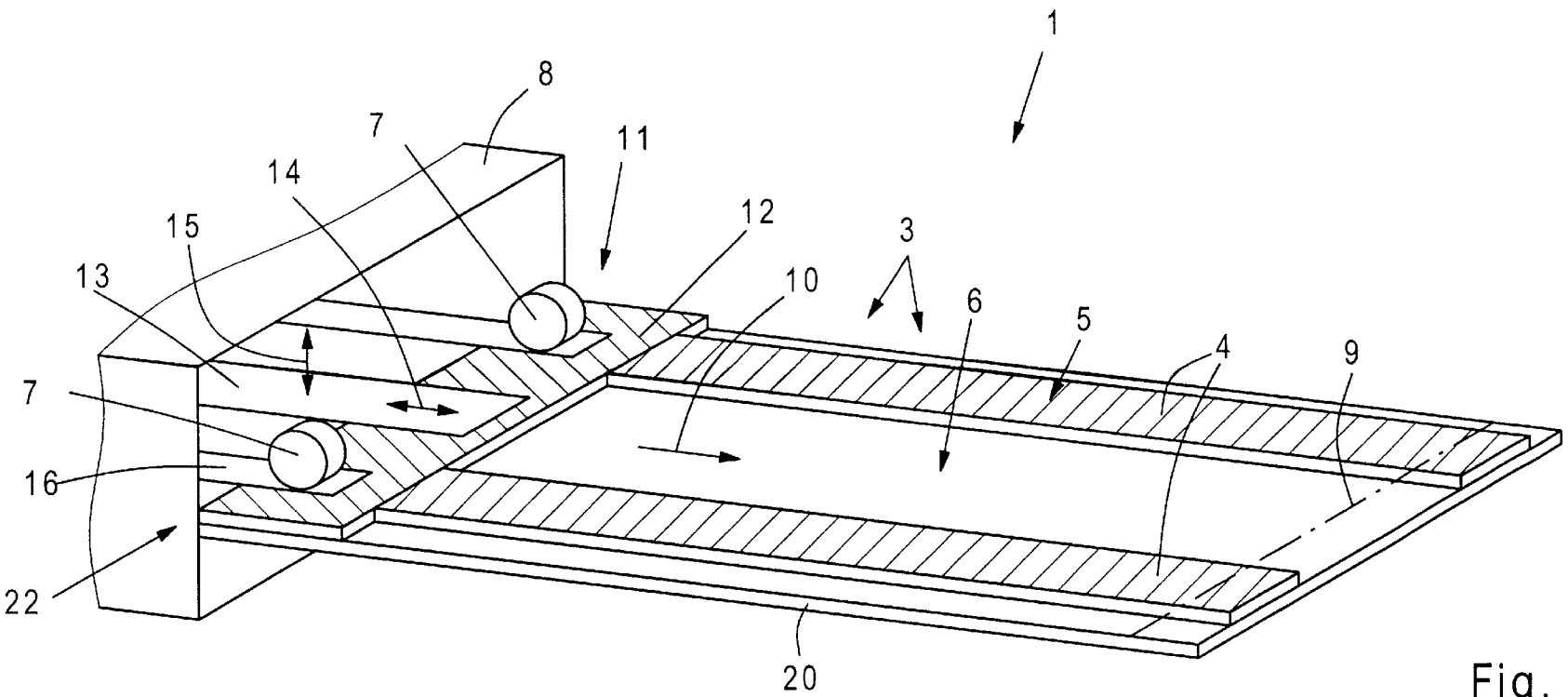

FIG. 1 shows an exemplified embodiment of a delivery system 1 in perspective view. By way of example, the delivery system 1 is provided at the delivery of a printing press 8 and is constructed as a delivery table 20. The purpose of the delivery table 1 is in conveying flat material 2 (see FIG. 2) up to a defined delivery position 9 and to position the front edges of the flat material 2 in this defined delivery position 9 such that a stack is formed.

In this connection, the positioning of the first flat material 2 is the most critical as too heavy friction on the delivery table 20 can have the result that the defined delivery position 9 is not achieved or not achieved in the exact alignment. In order to effect his, the invention provides that glide elements 4 extending on a guideway 3 in the direction of conveyance 10 are disposed with surfaces 5 which exhibit vis-à-vis the flat material 2 the lowest possible friction. In this manner it is achieved that the flat material 2 is conveyed in the direction of the arrow 10 and at the same time only slides on the surfaces 5 of the glide elements 4. When thereafter the flat materal 2 comes to a stop with its front edge in the defined delivery position 9, then the flat material 2 deposits itself in such a way that it comes into contact with the surface 6 of the guideway 3 and is securely held because this surface 6 exhibits high friction vis-à-vis the flat material 2.

In order to safely assure this function, provision is made for a height differential between the surfaces 5 of the glide elements 4 and the surface 6 of the guideway 3, which is dimensioned such that the flat material, during conveyance, does not yet come into contact with the surface 6 but which, however, when at a standstill, does deflect and, at the same time, touches the surface 6 of the guideway 3. In addition to the corresponding dimensioning of the height differential of the surfaces 5 and 6, further provision can be made that distancing of the glide elements 4 is dimensioned in such a way that this deflection is achieved. It can also be provided for this reason that not only two glide elements 4 extend along the guideway 3 but, rather, that a larger number is provided, as a result of which narrower surface strips 6 of the guideway 3 arise and heavier deflection of the flat material 2 is required, which takes place slower and, as a result thereof, contact of the surface 6 only occurs when the material 2 is at a standstill.

To achieve the defined delivery position 9 by the flat material 2, a surface 12 with increased friction can be provided in the back area 11 of the delivery table 20. This increased friction brakes the flat material 2 and ensures secure positioning during delivery. Conveyor rollers 7 can also be used for secure positioning.

Figure 2:
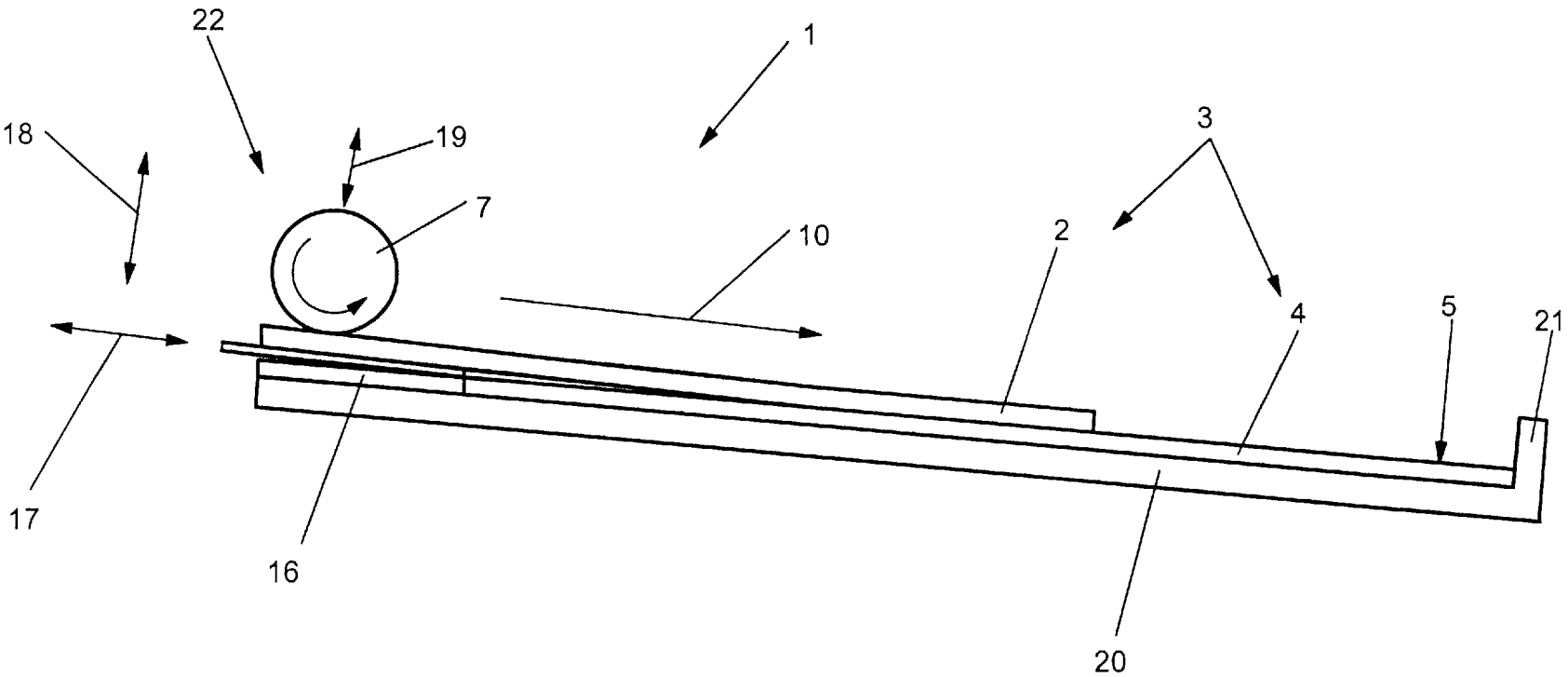

FIG. 1 and FIG. 2 show a conveyor roller 7 construction with additional elements 13 and 16 to achieve a defined delivery position 9. The conveyor rollers 7 are expediently combined with tongues 16, in which case the conveyor rollers 7 with their high friction surface vis-à-vis the flat material 2, convey the flat material 2 through rotation until the defined delivery position 9 is attained and then brake at the correct moment. The conveyor rollers 7 expediently act together with the tongues 16 which exhibit low friction and are disposed such that the flat material 2 slides on the tongues 16 and is conveyed by the conveyor rollers 7.

When a flat material 2 reaches the defined delivery position 9, a hold-down clamp 13 is actuated with a vertical movement in such manner that it holds the flat material 2 in the defined delivery position 9. The conveyor rollers 7 subsequently lift through a vertical movement 19 and the tongues 16 are retracted in the direction of the double arrow 17 counter to the direction of conveyance 10, whereby the back end of the flat material 2 deposits itself.

This process takes place during the delivery of all sheets of the flat material 2; it is, however, above all advantageous for the first sheet of flat material 2 because this ensures that the flat material 2 slides safely over the surface 12 with increased friction and then reaches, by the surfaces 5 with low friction, the defined delivery position 9 and is securely positioned by the surfaces 6 and 12 with increased friction. For delivery of the next flat material 2, the tongues 16 are repositioned through a horizontal movement 4 and a vertical movement 5 into the position shown and the conveyor rollers 7 drop in such a way that a flat material 2 can again be conveyed between the tongues 16 and the conveyor rollers 7 up to the defined delivery position 9. The horizontal movement 14 of the holding-down clamp 13 functions as retraction means so that a new sheet can be delivered. In the exemplified embodiment of FIG. 2, a stop 21 is provided in order to attain the defined delivery position 9.

The description is only exemplary in nature; it is, of course, possible to combine the glide elements 4 in accordance with the invention also with a different kind of conveyance and positioning device 22, exclusively with the conveyor rollers 7, or in any combination of conveyor rollers 7, surface 12 with increased friction and/or stop 21. The disposition of the delivery system 1 as a delivery table 20 or at a printing press 8 is also merely illustrative. The delivery system 1 can have any refinements which ultimately accomplish the purpose that a flat material can be conveyed into a defined delivery position 9.

LIST OF REFERENCE SYMBOLS

1 delivery system
2 flat material
3 guideway
4 glide elements
5 gliding element surface
6 guideway surface
7 conveyor rollers
8 printing press
9 defined delivery position
10 arrow: direction of conveyance
11 back area
12 surface with increased friction
13 holding-down clamp
14 double arrow: horizontal movement of holding-down clamp
15 double arrow: vertical movement of holding-down clamp
16 tongues
17 double arrow: horizontal movement of tongues
18 double arrow: vertical movement of tongues
19 double arrow: vertical movement of rollers
20 delivery table
21 stop
22 conveyance and positioning device

What is claimed is:

1. Delivery system (1) for flat material (2), in particular sheet paper, with a guideway (3) and at least two glide elements (4) extending in the direction of conveyance (10), whose surface (5) vis-à-vis the guideway (3) is elevated in construction, characterized in that said surfaces (5) of said glide elements (4) opposite a surface (6) of said guideway (3) exhibit substantially reduced friction vis-à-vis the flat material (2).

2. Delivery system according to claim 1, characterized in that said guideway (3) is a delivery table (20) and that an increased friction of said guideway (3) surface (6) and the height differential of this surface (6) to said surface (5) of said glide elements (4) are dimensioned in such a way that a flat material (2), upon completion of its conveyance, deposits itself non-slippably on said surface (6) of said guideway (3).

3. Delivery system according to claim 2, characterized in that said glide elements (4) are constructed as strips secured by gluing to said surface (6) of said guideway (3).

4. Delivery system according to claim 3, characterized in that the glide elements (4) are made of polytetrafluoroethylene.

5. Delivery system according to claim 2, characterized in that it is equipped with a conveyance and positioning device (22).

6. Delivery system according to claim 5, characterized in that said conveyance and positioning device (22) includes conveyor rollers (7) with high friction surfaces and a control mechanism, which convey the flat material (2) in a predetermined manner.

7. Delivery system according to claim 6, characterized in that a stop (21) is provided at the end of said guideway (3), and said flat material is delivered to said stop (21).

8. Delivery system according to claim 5, characterized in that a surface (12), with increased friction, is provided in an area (11) of said delivery table (20) in juxtaposition with said conveyor rollers (7).

9. Delivery system according to claim 8, characterized in that increased friction for said surface (12) is formed by a glued-on strip.

10. Delivery system according to claim 9, characterized in that said glued-on strip is rubber.

11. Delivery system according to claim 8, characterized in that tongues (16) are provided by which the flat material (2) slides over said surface (12) with increased friction and which, after delivery of the material (2), can be withdrawn from said delivery area.

* * * * *